US005794553A

United States Patent [19]

Futamura

[11] Patent Number: 5,794,553

[45] Date of Patent: Aug. 18, 1998

[54] EMBROIDERY DATA PROCESSING APPARATUS

[75] Inventor: Masao Futamura, Nagoya, Japan

[73] Assignee: Brother Kogyo Kabushiki Kaisha, Nagoya, Japan

[21] Appl. No.: 767,332

[22] Filed: Dec. 16, 1996

[30] Foreign Application Priority Data

Dec. 20, 1995 [JP] Japan ..... 7-332363

[51] Int. Cl.[6] ..... D05C 5/06; G06F 19/00

[52] U.S. Cl. ..... 112/102.5; 112/475.19; 364/470.09

[58] Field of Search ..... 112/102.5, 470.04, 112/470.06, 475.05, 475.19, 475.18; 364/470.09, 470.07, 470.08

[56] References Cited

U.S. PATENT DOCUMENTS

| | | | |
|---|---|---|---|
| 5,474,000 | 12/1995 | Mizuno et al. | 112/102.5 |
| 5,558,033 | 9/1996 | Futamura et al. | 112/475.19 |
| 5,563,795 | 10/1996 | Futamura et al. | 364/470.09 |

FOREIGN PATENT DOCUMENTS

| | | |
|---|---|---|
| A-6-142358 | 5/1994 | Japan . |
| A-6-233882 | 8/1994 | Japan . |
| A-7-31771 | 2/1995 | Japan . |

*Primary Examiner*—Peter Nerbun
*Attorney, Agent, or Firm*—Oliff & Berridge PLC

[57] ABSTRACT

An apparatus for processing embroidery data according to which a sewing machine produces an embroidery on a work sheet, including an embroidery-shape determining device for determining at least one embroidery shape in an original image, based on original-image data representing the original image, a characteristic-data determining device for determining characteristic data based on a color characteristic of the embroidery shape determined by the embroidery-shape determining device, and a sewing-attribute determining device for determining one or more sewing attributes each relating to sewing of the embroidery shape, based on the characteristic data determined by the characteristic-data determining device, the one or more sewing attributes including a stitch density at which the sewing machine sews the embroidery shape.

30 Claims, 8 Drawing Sheets

| STATISTIC VALUES | | | SEWING ATTRIBUTES | |
|---|---|---|---|---|
| Rm | Gm | Bm | THREAD COLOR | STITCH DENSITY (STITCHES/mm) |
| 0 | 0 | 0 | BLACK | 6 |
| 0 | 0 | 2 | BLUE | 6 |
| 0 | 0 | 4 | | 5 |
| ⋮ | ⋮ | ⋮ | ⋮ | ⋮ |
| 2 | 2 | 2 | BLACK | 5 |
| ⋮ | ⋮ | ⋮ | ⋮ | ⋮ |
| 14 | 14 | 14 | WHITE | 4 |

FIG. 7

| STATISTIC VALUES | | | SEWING ATTRIBUTES | |
|---|---|---|---|---|
| Rm | Gm | Bm | THREAD COLOR | STITCH DENSITY (STITCHES/mm) |
| 0 | 0 | 0 | BLACK | 6 |
| 0 | 0 | 2 | BLUE | 6 |
| 0 | 0 | 4 | | 5 |
| ⋮ | ⋮ | ⋮ | ⋮ | ⋮ |
| 2 | 2 | 2 | BLACK | 5 |
| ⋮ | ⋮ | ⋮ | ⋮ | ⋮ |
| 14 | 14 | 14 | WHITE | 4 |

FIG. 9

| STATISTIC VALUES (LUMINANCE) | SEWING ATTRIBUTES (STITCH DENSITY) (STITCHES/mm) |
|---|---|
| 0 | 6 |
| 2 | 6 |
| • | • |
| 6 | 5 |
| • | • |
| • | • |
| • | • |
| • | • |
| • | • |
| 15 | 4 |

EMBROIDERY DATA PROCESSING APPARATUS

BACKGROUND OF THE INVENTION

1. Field of the Invention

The present invention relates to an apparatus for processing embroidery data according to which a sewing machine produces an embroidery on a work sheet.

2. Related Art Statement

There has been known, for example in the field of industrial sewing machines, the technique of producing, from a desired original color image, embroidery data according to which a sewing machine forms, on a work sheet, a multi-color embroidery using two or more color threads. Meanwhile, the demands of people have been diversified and sophisticated and the performance of embroidery sewing machines has been improved. In the background, even domestic embroidery machines have been required to be able to form an embroidery according to not only embroidery data pre-stored therein but also embroidery data corresponding to user's desired original image. Such embroidery systems should be able to be purchased at low price and operated with ease. In particular, such an embroidery-data processing apparatus has been demanded which can produce embroidery data according to which a sewing machine forms a multi-color embroidery using two or more color embroidery threads.

There is known an embroidery-data processing apparatus which includes an image scanner for reading a desired original image, a display for displaying the original image, and a mouse or the like for tracing two or more embroidery shapes, such as embroidery area or embroidery line segment, present in the original image being displayed on the display. The prior apparatus further includes an input device which is manually operable by the user for inputting one or more sewing attributes, such as thread color and/or stitch density, which relate to sewing of each of the embroidery shapes. Thus, the prior apparatus produces embroidery data for forming a multi-color embroidery using two or more color threads.

However, the above-identified prior apparatus requires the user to input manually one or more sewing attributes for each of the user's desired embroidery shapes present in the original image. This operation is very cumbersome and time-consuming. This problem is worsened, in particular, in the case where the user wants to embroidery a plurality of embroidery areas with different color threads, respectively.

SUMMARY OF THE INVENTION

It is therefore an object of the present invention to provide an apparatus for easily and quickly processing embroidery data even in the case where an embroidery corresponding to a multi-color original image is produced according to embroidery data.

The above object has been achieved by the present invention. According to a first aspect of the present invention, there is provided an apparatus for processing embroidery data according to which a sewing machine produces an embroidery on a work sheet, comprising embroidery-shape determining means for determining at least one embroidery shape in an original image, based on original-image data representing the original image; characteristic-data determining means for determining characteristic data based on a color characteristic of the embroidery shape determined by the embroidery-shape determining means; and sewing-attribute determining means for determining at least one sewing attribute relating to sewing of the embroidery shape, based on the characteristic data determined by the characteristic-data determining means, the at least one sewing attribute comprising a stitch density at which the sewing machine sews the embroidery shape.

In the embroidery-data processing apparatus in accordance with the first aspect of the invention, the sewing-attribute determining means automatically determines one or more sewing attributes relating to sewing of the embroidery shape, based on the characteristic data determined by the characteristic-data determining means. The one or more sewing attributes includes stitch density. Thus, the present apparatus does not require an operator or a user to input one or more sewing attributes for each of embroidery shapes present in a desired original image. That is, the present apparatus can easily and quickly process embroidery data. Since the sewing-attribute determining means can determine, based on the characteristic data, one or more sewing attributes which are the most appropriate for the sewing of each embroidery shape, the sewing machine can produce an embroidery well corresponding to the original image.

According to a preferred feature of the first aspect of the invention, the processing apparatus further comprises embroidery-data producing means for producing the embroidery data based on the sewing attribute determined by the sewing-attribute determining means. The embroidery data may comprise data indicative of the determined sewing attribute.

According to another feature of the first aspect of the invention, the embroidery-data producing means comprises means for producing the embroidery data comprising a plurality of sets of stitch-position data defining a plurality of stitch positions where a sewing needle of the sewing machine penetrates the work sheet, and the sewing-attribute determining means comprises means for determining, as the sewing attribute, the stitch density indicating a number of stitches formed in unit length in an embroidery direction in the embroidery shape.

According to another feature of the first aspect of the invention, the embroidery-data producing means comprises means for producing the embroidery data comprising (a) a plurality of sets of block data defining a plurality of rectangle blocks each of which is to be filled with stitches formed by the sewing machine, and (b) the sewing attribute, and the sewing-attribute determining means comprises means for determining, as the sewing attribute, the stitch density indicating a number of stitches formed in the each block. The embroidery data may comprise one or more sets of block data defining one or more triangle blocks.

According to another feature of the first aspect of the invention, the embroidery-data processing apparatus further comprises a recording device which records the embroidery data produced by the embroidery-data producing means, on a recording medium which is removable from the embroidery-data processing apparatus.

According to another feature of the first aspect of the invention, the embroidery-data processing apparatus further comprises an original-image-data obtaining device which obtains the original-image data.

According to another feature of the first aspect of the invention, the original-image-data obtaining device comprises an image pick-up device which picks up the original image on which at least one outline of an embroidery area has been recorded with a recording material, the image pick-up device producing the original-image data representing the original image, and the embroidery-shape determining means comprises means for determining, as the embroidery shape, the embroidery area in the original image, based on the original-image data which are produced by the image pick-up device and which include outline data representing the outline of the embroidery area recorded with the recording material. In this case, the operator or the user can utilize his or her color sensation for recording, with a recording material, such a color ink, having a predetermined color, the outline of desired embroidery area present in the original image. Therefore, the present apparatus can automatically determine the outline of user's desired embroidery area with high accuracy.

According to another feature of the first aspect of the invention, the original-image-data obtaining device comprises an image pick-up device which picks up the original image and produces the original-image data representing the original image; a display device which displays the original image represented by the original-image data; and an input device which is operable by a user for inputting line data representing at least one of (a) at least one outline of an embroidery area and (b) an embroidery line segment, while the user views the original image displayed by the display device, and the embroidery-shape determining means comprises means for determining, as the embroidery shape, the at least one of the embroidery area and the embroidery line segment in the original image, based on the line data input through the input device. In this case, too, the user can utilize his or her color sensation for recording, with the recording material, the outline of desired embroidery area present in the original image, and the apparatus can automatically determine the outline of user's desired embroidery area with high accuracy. In the case where an embroidery line segment such as straight or curved segment is input by the user, the sewing attribute may be a stitch density indicating a number of zigzag stitches formed in unit length along the line segment.

According to another feature of the first aspect of the invention, the original-image-data obtaining device comprises color-data obtaining means for obtaining the original-image data comprising a plurality of sets of color data relating to respective colors of a plurality of picture elements of the original image.

According to another feature of the first aspect of the invention, the characteristic-data determining means comprises statistic-value determining means for statistically processing the sets of color data relating to the respective colors of the picture elements each of which belongs to the embroidery shape, and determining at least one statistic value as the characteristic data.

According to another feature of the first aspect of the invention, the processing apparatus further comprises a memory which stores the sets of color data relating to the respective colors of the picture elements each of which belongs to the embroidery shape.

According to another feature of the first aspect of the invention, the color-data obtaining means comprises means for obtaining the sets of color data each set of which comprises red data indicating a red degree of the color of a corresponding one of the picture elements of the original image, green data indicating a green degree of the color of the corresponding one picture element, and blue data indicating a blue degree of the color of the corresponding one picture element.

According to another feature of the first aspect of the invention, the statistic-value determining means comprises means for determining, as the at least one statistic value, a median of the respective red degrees, a median of the respective green degrees, and a median of the respective blue degrees, of the picture elements of the embroidery shape.

According to another feature of the first aspect of the invention, the sewing-attribute determining means comprises means for determining the at least one sewing attribute comprising the stitch density and a color of at least one sewing thread with which the sewing machine sews the embroidery shape. In this case, the stitch density and the sewing-thread color as the sewing attributes correspond with accuracy to the color characteristic of the embroidery shape. Thus, a high-quality embroidery is produced by the sewing machine.

According to another feature of the first aspect of the invention, the color-data obtaining means comprises means for obtaining the sets of color data each set of which comprises color-density data indicating a density of the color of a corresponding one of the picture elements of the original image. In this case, the sets of color data may be either sets of full-color data or sets of monochromatic-color or gray-scale data.

According to another feature of the first aspect of the invention, the statistic-value determining means comprises color-density-using static-value determining means for determining the statistic value based on the respective color densities of the picture elements of the embroidery shape. In this case, the stitch density as the sewing attribute corresponds with accuracy to the color density of the embroidery shape. Thus, a high-quality embroidery is produced by the sewing machine.

According to another feature of the first aspect of the invention, the color-density-using statistic-value determining means comprises means for determining, as the statistic value, a sum of respective luminances as the respective color densities of the picture elements of the embroidery shape.

According to another feature of the first aspect of the invention, the processing apparatus further comprises a memory which stores the original image data.

According to another feature of the first aspect of the invention, the sewing-attribute determining means comprises a memory which stores a relationship between a plurality of values of the characteristic data and a plurality of classes of the sewing attribute which correspond to the values of the characteristic data, respectively; and means for determining, as the sewing attribute, one of the classes of the sewing attribute which corresponds to one of the values of the characteristic data which is nearest to a value of the characteristic data determined by the characteristic-data determining means. In this case, the determined sewing attribute corresponds with high accuracy to the color characteristic of the embroidery shape.

According to another feature of the first aspect of the invention, the sewing-attribute determining means comprises a memory which stores a relationship between a plurality of discontinuous values of the characteristic data and a plurality of classes of the sewing attribute which correspond to the values of the characteristic data, respectively; means for determining, as the sewing attribute, one of the classes of the sewing attribute which corresponds to one of the values of the characteristic data which is nearest to a value of the characteristic data determined by the characteristic-data determining means; an input device which is operable by a user for inputting data indicating a desired class of the sewing attribute; and means for adopting, as the sewing attribute, the desired class of the sewing attribute input through the input device, when a difference between the value of the characteristic data determined by the characteristic-data determining means and the one value of the characteristic data which is nearest to the value of the characteristic data determined by the characteristic-data determining means is greater than a reference value. The present apparatus can effectively prevent itself from automatically determining an inappropriate sewing attribute far from the color characteristic of the embroidery shape, and additionally prevent the user from inputting an inappropriate sewing attribute through the input device.

According to a second aspect of the present invention, there is provided an apparatus for processing embroidery data according to which a sewing machine produces an embroidery on a work sheet, comprising embroidery-shape determining means for determining at least one embroidery shape in an original image, based on original-image data representing the original image; characteristic-data determining means for determining characteristic data based on a color characteristic of the embroidery shape determined by the embroidery-shape determining means; and sewing-attribute determining means for determining at least one sewing attribute relating to sewing of the embroidery shape, based on the characteristic data determined by the characteristic-data determining means, the sewing-attribute determining means comprising a memory which stores a relationship between a plurality of values of the characteristic data and a plurality of classes of the sewing attribute which correspond to the values of the characteristic data, respectively, and a means for determining, as the sewing attribute, one of the classes of the sewing attribute which corresponds to one of the values of the characteristic data which is nearest to a value of the characteristic data determined by the characteristic-data determining means.

The processing apparatus in accordance with the second aspect of the invention enjoys the same advantages as those of the processing apparatus in accordance with the first aspect of the invention. In addition, the present apparatus enjoys the advantage that the sewing attribute determined corresponds with high accuracy to the color characteristic of the embroidery shape.

According to a third aspect of the present invention, there is provided an apparatus for processing embroidery data according to which a sewing machine produces an embroidery on a work sheet, comprising embroidery-shape determining means for determining at least one embroidery shape in an original image, based on original-image data representing the original image; characteristic-data determining means for determining characteristic data based on a color characteristic of the embroidery shape determined by the embroidery-shape determining means; sewing-attribute determining means for determining one of a plurality of classes of at least one sewing attribute relating to sewing of the embroidery shape, based on the characteristic data determined by the characteristic-data determining means; an input device which is operable by a user for inputting data indicating a desired class of the sewing attribute; and a means for adopting, according to a predetermined rule, the desired class of the sewing attribute input through the input device, in place of the one class of the sewing attribute determined by the sewing-attribute determining means.

The processing apparatus in accordance with the third aspect of the invention enjoys the same advantages as those of the processing apparatus in accordance with the first aspect of the invention. In addition, the present apparatus enjoys the advantage that the user can selecting his or her desired sewing attribute in place of the sewing attribute automatically determined by the sewing-attribute determining means.

According to a fourth aspect of the present invention, there is provided a process of processing embroidery data according to which a sewing machine produces an embroidery on a work sheet, comprising the steps of recording, with a recording material, at least one outline defining an embroidery area in an original image, obtaining original-image data representing the original image including the at least one outline, determining, based on the original-image data, the embroidery area defined by the at least one outline, determining characteristic data based on a color characteristic of the determined embroidery area, and determining at least one sewing attribute relating to sewing of the embroidery area, based on the determined characteristic data.

The embroidery-data processing method in accordance with the fourth aspect of the invention enjoys the same advantages as those of the processing apparatus in accordance with the first aspect of the invention. In addition, the present process enjoys the advantage that the user can utilize his or her color sensation for recording, with the recording material, the outline of his or her desired embroidery area present in the original image. Therefore, in the present process, the outline of user's desired embroidery area can be determined with high accuracy.

According to a preferred feature of the fourth aspect of the invention, the step of determining the at least one sewing attribute comprises determining the at least one sewing attribute comprising at least one of a stitch density and a color of a sewing thread.

According to another feature of the fourth aspect of the invention, the embroidery-data processing process further comprises the step of producing the embroidery data based on the determined sewing attribute.

According to another feature of the fourth aspect of the invention, the embroidery-data processing process further comprises the step of producing the embroidery on the work sheet according to the produced embroidery data.

According to a fifth aspect of the present invention, there is provided a recording medium in which a control program is recorded which is readable by a computer and usable to process embroidery data according to which a sewing machine produces an embroidery on a work sheet, the program comprising the steps of determining at least one embroidery shape in an original image, based on original-image data representing the original image, determining characteristic data based on a color characteristic of the determined embroidery shape, and determining at least one sewing attribute relating to sewing of the embroidery shape, based on the determined characteristic data, the at least one sewing attribute comprising a stitch density at which the sewing machine sews the embroidery shape.

The recording medium in accordance with the fifth aspect of the invention enjoys the same advantages as those of the processing apparatus in accordance with the first aspect of the invention. The recording medium may be a read only memory (ROM) of a microcomputer or a floppy disk from which the computer reads the control program and stores it in the ROM.

According to a preferred feature of the fifth aspect of the invention, the control program further comprises the step of producing the embroidery data based on the determined sewing attribute.

According to another feature of the fifth aspect of the invention, the control program further comprises the step of recording the embroidery data on a recording medium which is removable from the computer.

According to another feature of the fifth aspect of the invention, the control program further comprises the step of obtaining the original-image data.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 7 is a view of a look-up table defining a relationship between different combinations of RGB statistic values, Rm, Gm, Bm, and different classes of sewing-thread color and stitch density as sewing attributes;

FIG. 9 is a view of another look-up table defining a relationship between different luminance values and different classes of stitch density as a sewing attribute.

DETAILED DESCRIPTION OF THE PREFERRED EMBODIMENTS

Figure 1:
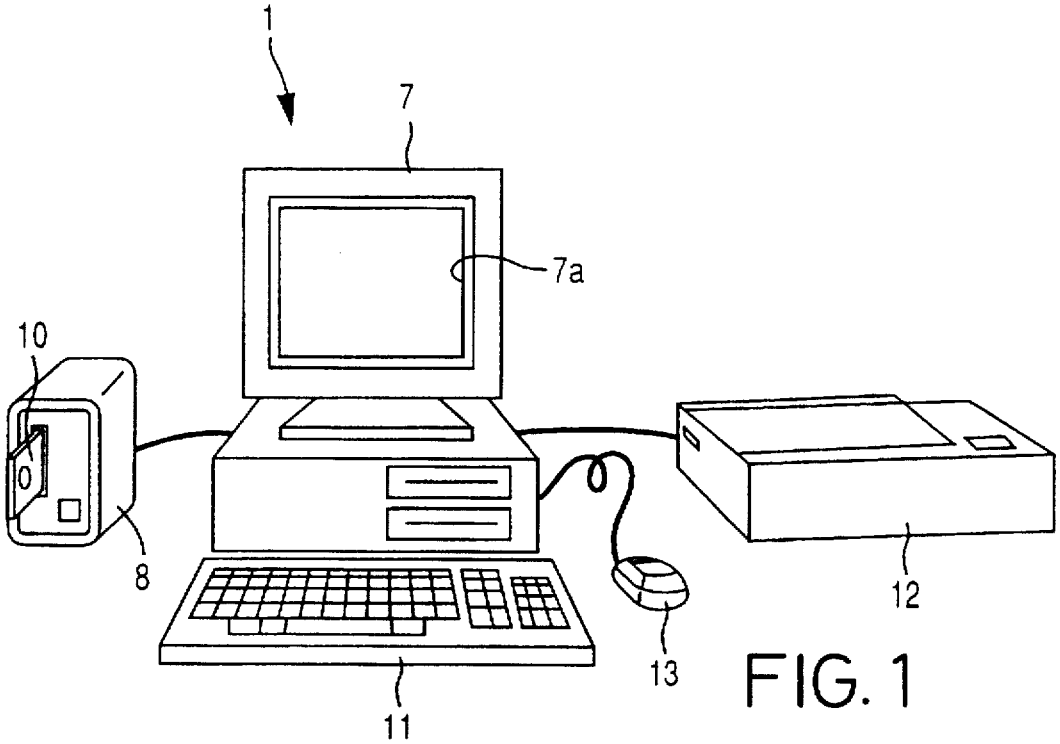
FIG. 1 is an external view of an embroidery-data processing apparatus to which the present invention is applied.

Referring first to FIGS. 1 to 8, there will be described an embroidery-data ("ED") processing apparatus 1 to which the present invention is applied. The ED processing apparatus 1 is adapted to process embroidery data which are used by a domestic, embroidery sewing machine 20.

First, an overall embroidering system including the ED processor 1 and the sewing machine 20 will be described. Embroidering begins when the ED processor 1 produces embroidery data. The embroidery data are supplied to the sewing machine 20, which produces a desired embroidery on a work sheet 22, such as a fabric or a leather, according to the supplied data. The embroidery data may comprise a plurality of sets of stitch-position data defining a plurality of stitch positions, respectively, where a sewing needle 26 of the sewing machine 20 penetrates the work sheet 22, or may comprise a plurality of sets of block data defining a plurality of rectangle and/or triangle blocks, respectively, which cooperate with one another to define approximately one or more outlines of an embroidery area.

Next, there will be described the construction of the ED processor 1 by reference to FIG. 1. The ED processor 1 includes an image scanner 12 as an image pick-up device which picks up an original color image 15 (FIG. 8A) such as a color photograph or a multi-colored drawing (i.e., drawing colored with two or more sorts of color inks). The image scanner 12 produces original-image data representing the scanned original image 15, and supplies the image data to an interface 6 of a control device 9 (FIG. 3), so that the original-image data are stored in an original-image-data storage area 4A of a random access memory (RAM) 4 of the control device 9. A central processing unit (CPU) 2 of the control device 9 processes the original-image data stored in the storage area 4A, into embroidery data, according to a control program which is pre-stored in a read only memory (ROM) 3 and which is represented by the flow chart of FIG. 5A, and by utilizing a temporary-storage function of the RAM 4. The embroidery data processed are recorded or stored in a flash-memory card 10 by a flash-memory reading and writing device 8 under control of the control device 9. When an operator removes the flash-memory card 10 from the reading and writing device 8 and inserts the card 10 into a card slot 24 of a flash-memory reading and writing device (not shown) incorporated in the sewing machine 20, a control device (not shown) of the sewing machine 20 reads the embroidery data from the card 10 and controls, according to the embroidery data, respective operations of the sewing needle 23 and a holder moving device 26 which moves a work holder 21 holding the work sheet 22, in a horizontal X-Y coordinate system prescribed for the sewing machine 20, so that an embroidery corresponding to the embroidery data is produced on the work sheet 22.

Figure 2:
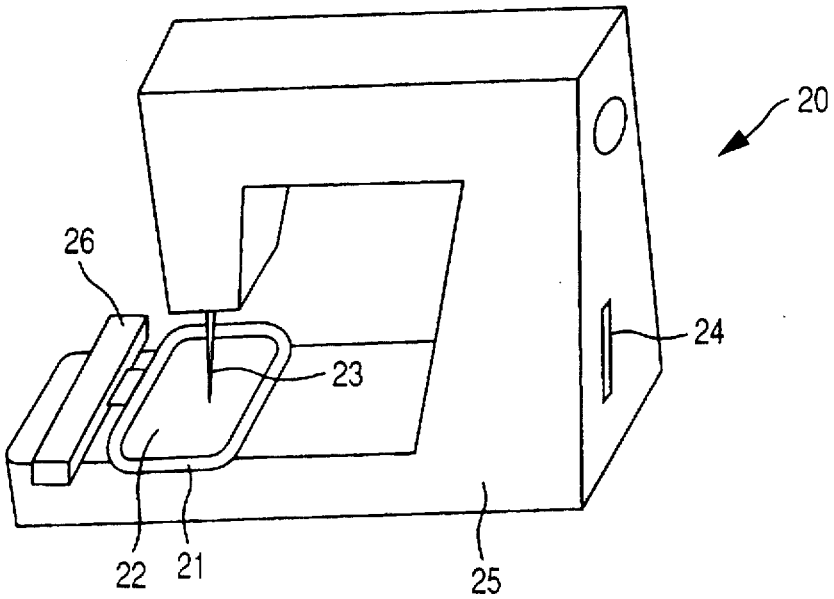
FIG. 2 is a perspective view of a domestic embroidery sewing machine which produces an embroidery according to embroidery data processed by the apparatus of FIG. 1.

Next, there will be described the construction of the domestic, embroidery sewing machine 20 by reference to FIG. 2. The sewing machine 20 includes a sewing bed 25 relative to which the work holder 21 holding the work sheet 22 is moved according to embroidery data by the holder moving device 26 to respective stitch positions on the specific X-Y coordinate system, while the sewing needle 23 is vertically reciprocated. Thus, an embroidery corresponding to the embroidery data is formed on the work sheet 22. In the case where embroidery data comprise sets of stitch-position data, each set of stitch-position data represents an x and a y coordinate of a corresponding stitch position in the X-Y coordinate system. The control device of the sewing machine 20, which may be provided by a microcomputer, reads the embroidery data from the flash-memory card 10 and controls, according to the data, the respective operations of the holder moving device 26 and the sewing needle 23, so that the embroidery corresponding to the embroidery data is formed on the work sheet 22 held by the work holder 21. In the case where embroidery data comprise sets of block data and stitch-density data indicative of a number of stitches formed in each block, the control device of the sewing machine 20 automatically determines stitch positions (i.e., x and y coordinates of stitch positions), based on the embroidery data, and controls the stitch-forming device 23, 26 to form stitches at the determined positions so as to fill each of rectangle and/or triangle blocks.

As described above and shown in FIG. 3, the control device 9 of the ED processor 1 includes the CPU 2, the ROM 3, the RAM 4, a bus 5, and the interface (I/F) 6. The CPU 2, ROM 3, RAM 4, and I/F 6 are connected to one another via the bus 5. The ROM 3 stores the embroidery-data processing control program represented by the flow chart of FIG. 5A, and a look-up table, shown in FIG. 7, used for determining sewing attributes (described later). The CPU 2 operates, according to the control program pre-stored in the ROM 3, for processing embroidery data to be supplied to the sewing machine 20. As shown in FIG. 4, the RAM 4 includes the original-image-data storage area 4A which stores the original-color-image data representing the original color image 15 read by the image scanner 12; an embroidery-shape-data storage area 4B which stores one or more sets of embroidery-shape data each set of which represents an embroidery shape (described later) in the original image; and a pixel-color-data storage area 4C which stores sets of color data (described later) for respective picture elements or pixels of each embroidery shape.

Figure 3:
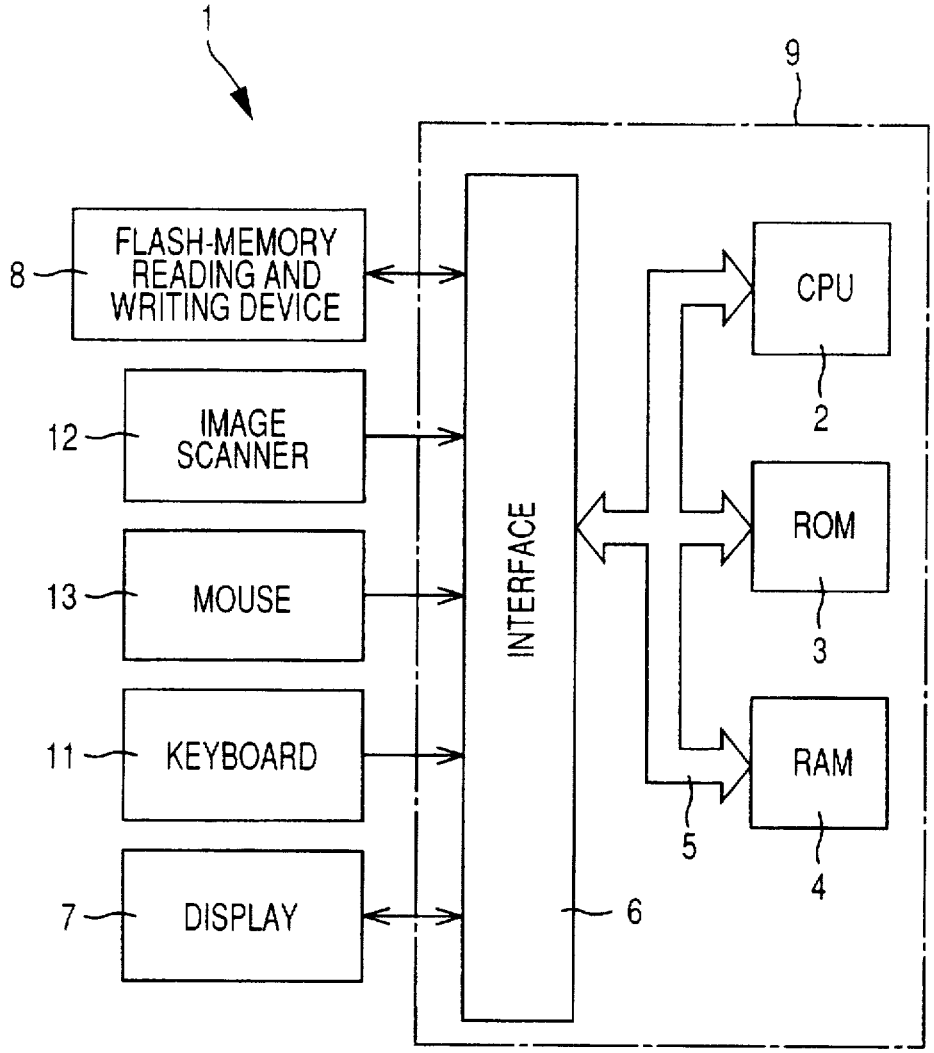
FIG. 3 is a diagrammatic view of a control device of the apparatus of FIG. 1.
Figure 4:
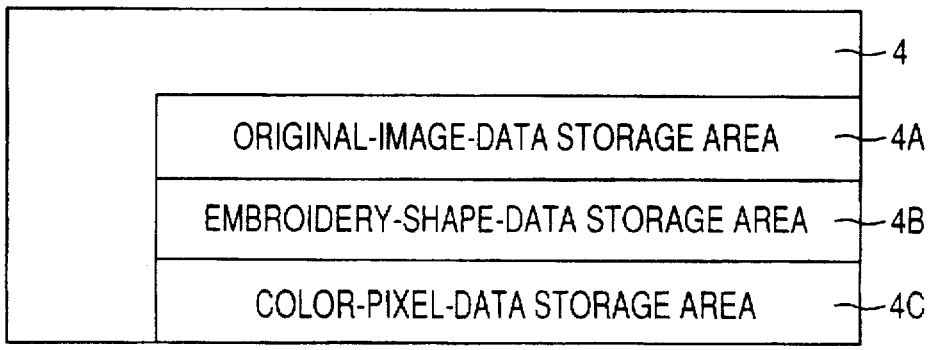
FIG. 4 is an illustrative view of a random access memory (RAM) of the control device of FIG. 3.

As shown in FIG. 3, the ED processing apparatus 1 includes, in addition to the control device 9, a CRT (cathode ray tube) display 7, the flash-memory reading and writing device 8, a keyboard 11, the image scanner 12, and a mouse 13. The image scanner 12 is a color-image scanner and, when reading an original color image 15 desired by the operator, produces original-color-image data representing the original color image 15. The CRT display 7 displays, on an image screen 7*a* thereof, the original color image 15 read by the image scanner 12. In the present embodiment, the operator can trace, with a recording material such as a color ink pen, an outline L1, L2, L3, or L4 (FIG. 8B) of each embroidery area on the original color image 15. In the latter case, the control device 9 automatically extracts, from the original-color-image data stored in the storage area 4A, the outline L1, L2, L3, L4 of each embroidery area in a known image processing technique, and produces a set of embroidery-shape data representing the outline L1, L2, L3, L4 of each embroidery area. The embroidery-shape data are stored in the storage area 4B. The outline L1, L2, L3, L4 of each embroidery area represented by the embroidery-shape data is displayed, on the CRT display 7, independent of the original color image 15, as shown in FIG. 8B. The flash-memory card 10 is inserted into the flash-memory reading and writing device 8, so that the embroidery data produced are stored in the card 10. The keyboard 11 is usable by the operator for inputting various sorts of data including data indicating a desired class of a sewing attribute (e.g., desired sewing-thread color or desired stitch-density value). The mouse 13 is usable by the operator for tracing one or more outlines of an embroidery area, and/or an embroidery line segment, in the original color image 15 which has been read by the image scanner 12 and is being displayed on the CRT display 7, thereby inputting embroidery-shape data representing the outline or outlines of the embroidery area and/or the embroidery line segment. The thus input embroidery-shape data are also stored in the storage area 4B of the RAM 4. The sewing-attribute data input through the keyboard 11 and the embroidery-shape data input through the mouse 13 are supplied via the I/F 6 and the bus 5 to the CPU 2 and the RAM 4.

In the present embodiment, the image scanner 12 functions as an original-image-data obtaining device; the control device 9 functions as an embroidery-shape determining means, a characteristic-data determining means, a sewing-attribute determining means, and an embroidery-data producing means; the flash-memory writing device 8 functions as a recording device; the CRT display 7 and the mouse 13 function as an input device for inputting one or more outlines of an embroidery area and/or an embroidery line segment as an embroidery shape; and the keyboard 11 functions as an input device for inputting a desired class of each of one or more sewing attributes. The image scanner 12 functions as the original-image-data obtaining device, at Step S1 of FIG. 5A; the control device 9 functions as the embroidery-shape determining means at Step S2, as the characteristic-data determining means at Step S6, as the sewing-attribute determining means at Step S7, and as the embroidery-data producing means at Step S8. The flash-memory writing device 8 functions as the recording device at Step S8; the CRT display 7 and the mouse 13 function as the input device for inputting the embroidery shape, at Steps S3 and S4; and the keyboard 11 functions as the input device for inputting the sewing attribute(s), at Step S72 of FIG. 5B.

Figure 5A:
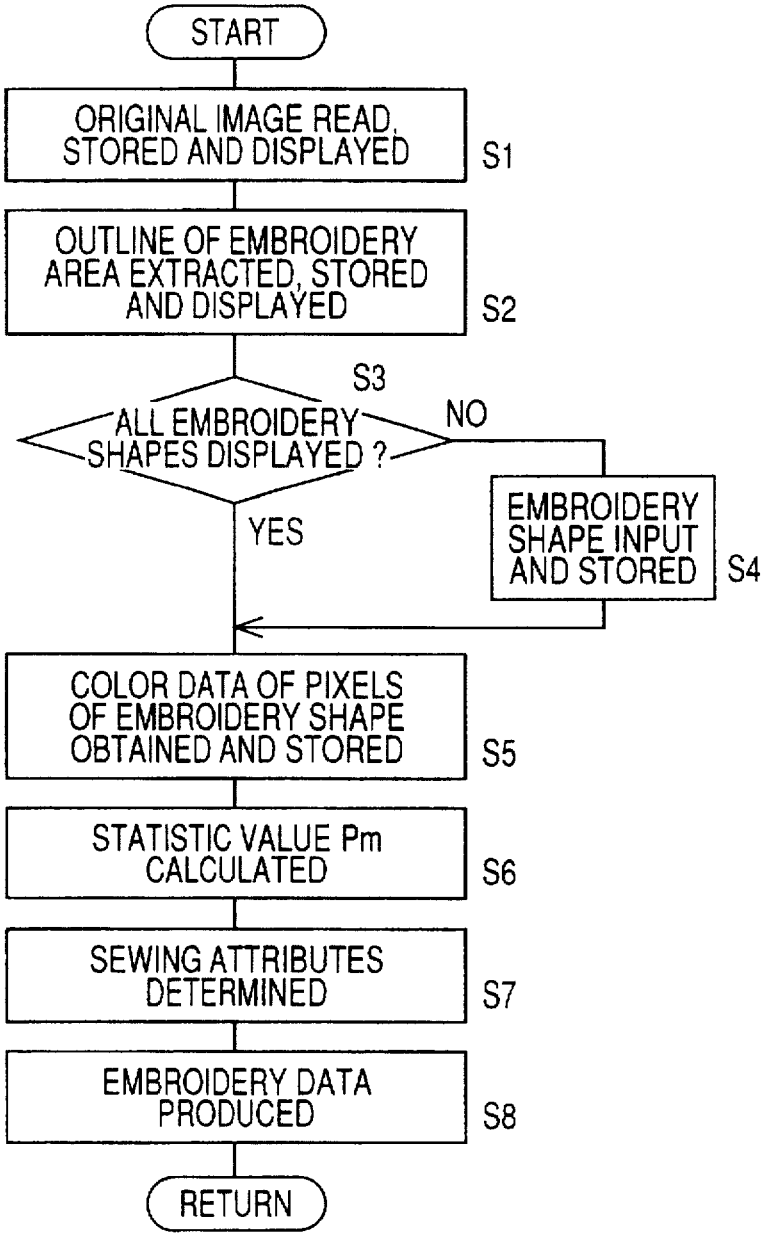
FIG. 5A is a flow chart representing an embroidery-data processing control program pre-stored in a read only memory (ROM) of the control device of FIG. 3.

Hereinafter, there will be described the operation of the embroidery-data processing apparatus 1 constructed as described above, by reference to FIGS. 5A, 6A, 6B, 6C, 7, 8A, and 8B. FIG. 5A represents an embroidery-data-processing control program according to which the control device 9 of the present apparatus 1 operates for processing embroidery data. The following description relates to the operation of the control device 9 for producing embroidery data from an example of an original color image 15 shown in FIG. 8A.

Figure 8A:
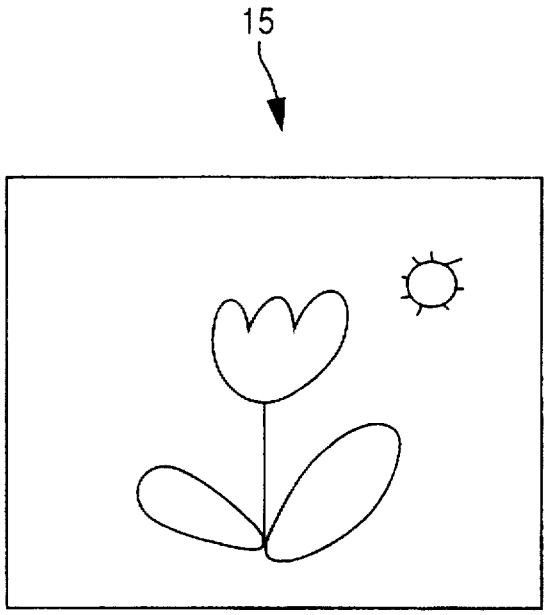
FIG. 8A is a view of an example of an original color image on which an outline of an embroidery area has been recorded with a color ink by a user.
Figure 8B:
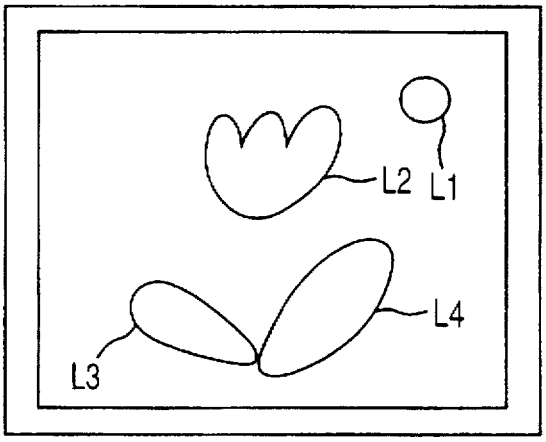
FIG. 8B is a view of an embroidery shape extracted from the original image of FIG. 8A and displayed on a display device of the apparatus of FIG. 1.

First, an operator prepares his or her desired original color image 15 as shown in FIG. 8A. The original image 15 may be a color picture or a multi-colored drawing. In the present embodiment, the operator records, with a recording material such as a color ink having a predetermined color, one or more outlines of each of one or more embroidery areas, and/or one or more embroidery line segments, on the original image 15. Regarding the original image 15, the operator draws, with a color ink, the outline of petals, the outline of each of two leaves, the line segment as the stem, the outline of the sun, and the line segments as the light beams of the sun.

When the control of the control device 9 or the CPU 2 thereof is initiated according to the control program of FIG. 5A, first, at Step S1, the operator scans or reads the original color image 15 using the image scanner 12. The scanner 12 produces original-image data representing the original color image 15 including the outlines and the line segments recorded with the color ink thereon by the operator. The original-image data comprise a number of sets of color picture-element or pixel data, $C_i$, corresponding to a number of picture elements or pixels of the original image 15. Each set of color pixel data $C_i$ indicates one, $R_i$, of sixteen red (R) grades (4 bits; 0 to 15) of the color of a corresponding one of the pixels; one, $G_i$, of sixteen green (G) grades (4 bits; 0 to 15) of the color of the corresponding one pixel; and one, $B_i$, of sixteen blue (B) grades (4 bits; 0 to 15) of the color of the corresponding one pixel. The sets of color-pixel data $C_i$ are stored in the original-image-data storage area 4A of the RAM 4 such that the sets of color-pixel data $C_i$ are associated with sets of x and y coordinates which define the respective positions of the corresponding pixels in the original image 15. The original color image 15 represented by the sets of color-pixel data $C_i$ is displayed on the image screen 7*a* of the CRT display 7, such that the displayed color image 15 has the same colors as those of the color image 15 on the original picture or drawing.

Step S1 is followed by Step S2 to determine automatically one or more embroidery shapes present in the original image 15 represented by the sets of color-pixel data $C_i$. In the present embodiment, the processing apparatus 1 produces embroidery data for embroidering the embroidery shape(s) only, and does not produce any embroidery data for the other areas or regions than the embroidery shape(s). An embroidery shape may be a closed area (e.g., circular area, doughnut-like area, etc.) bounded by one or more outlines, or a curved or straight line segment. An embroidery closed area is filled with stitches such as satin stitches or seed stitches; and zigzag stitches, for example, are formed along an embroidery line segment. An embroidery area may be divided into a plurality of rectangle and/or triangle blocks. In the latter case, each block is filled with stitches. A sewing attribute is a variable parameter relating to sewing of an embroidery shape. The sewing attribute(s) may be stitch density and/or sewing-thread color.

More specifically described, at Step S2, the CPU 2 applies a known outline-extracting processing procedure, to the sets of color-pixel data $C_i$ stored in the RAM 4, and thereby automatically determines and extracts the outline of each of one or more embroidery areas present in the original image 15 represented by the data $C_i$. The outline-extracting processing procedure is well known in the art and the description thereof is omitted. The CPU 2 produces one or more sets of embroidery-shape data representing the thus extracted outline or lines of the embroidery area or areas. The thus produced set(s) of embroidery-shape data are stored in the embroidery-shape-data storage area 4B of the RAM 4. The outlines of the embroidery areas represented by the sets of embroidery-shape data are displayed on the image screen 7*a* of the CRT display 7 as shown in FIG. 8B. Regarding the original image 15 of FIG. 8A, the CPU 2 extracts four outlines L1, L2, L3, L4, and the display 7 displays those outlines L1 to L4.

Step S2 is followed by Step S3 to display, on the image screen 7*a*, a message "ALL DESIRED EMBROIDERY SHAPES ARE DISPLAYED?" According to the above-indicated outline-extracting procedure, the CPU 2 can determine the outline(s) of each embroidery area but cannot determine any line segment that does not define a closed area. Thus, the CPU 2 cannot determine, as one or more embroidery shapes, one or more line segments present in the original image 15. Regarding the example of FIG. 8A, the CPU 2 cannot determine the line segment corresponding to the stem, or the line segments corresponding to the light beams of the sun, as the embroidery shapes. Hence, if the operator inputs "NO" through the keyboard 11, the control of the CPU 2 goes to Step S4 to display, on the screen 7*a*, a message "PLEASE INPUT DESIRED EMBROIDERY SHAPE(S)". The operator can input not only one or more line segments but also an outline of each of one or more embroidery areas. More specifically described, the operator traces, using the mouse 13, the stem of the flower and the light beams of the sun, on the screen 7*a*. The CPU 2 produces sets of embroidery-shape data representing the thus input line segments and stores the sets of embroidery-shape data in the storage area 4B of the RAM 4. The line segments represented by the sets of embroidery-shape data are displayed on the screen 7*a*. Thus, the determination of one or more embroidery shapes present in an original image 15 is finished.

In the present embodiment, Steps S2 and S3 are option steps. The operator can select one of a first mode in which Steps S2 and S3 are carried out and a second mode in which Steps S2 and S3 are omitted. In the case where an original image includes, as embroidery shapes, a great number of line segments and a small number of embroidery areas, the operator may select the second mode to input the embroidery shapes with higher efficiency. In place of the mouse 3 functioning as the input device for inputting the embroidery shapes, it is possible to employ a track ball, a light-pen, a pressure-sensing pad, etc.

Subsequently, the control of the CPU 2 goes to Step S5 to obtain, from the original-image data stored in the storage area 4A, the sets of color-pixel data $P_i$ corresponding to the pixels belonging to each of the embroidery shapes represented by the sets of embroidery-shape data stored in the storage area 4B. The sets of color-pixel data $P_i$ cooperate with one another to define at least one color characteristic of each embroidery shape. In the case where an embroidery shape is a closed area, the sets of color-pixel data $P_i$ correspond to all the pixels inside the outline or outlines of the closed area. In the case where an embroidery shape is a line segment, the sets of color-pixel data $P_i$ correspond to all the pixels on the line segment. The sets of color-pixel data $P_i$ for each embroidery shape are stored in the color-pixel-data storage area 4C of the RAM 4.

Figure 6A:
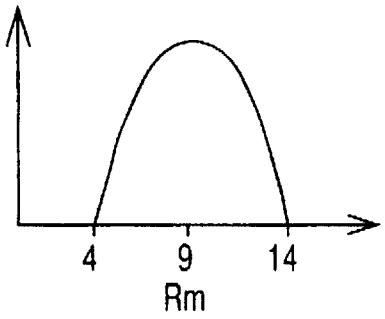
FIG. 6A is a graph showing a distribution of respective red (R) components of picture elements or pixels of an embroidery shape in an original color image.
Figure 6B:
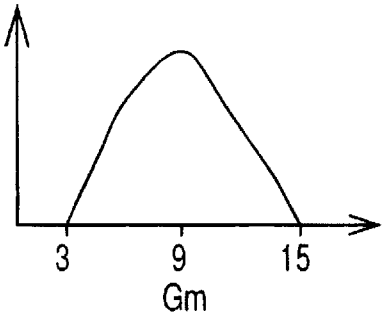
FIG. 6B is a graph showing a distribution of respective green (G) components of the picture elements of the same embroidery shape.
Figure 6C:
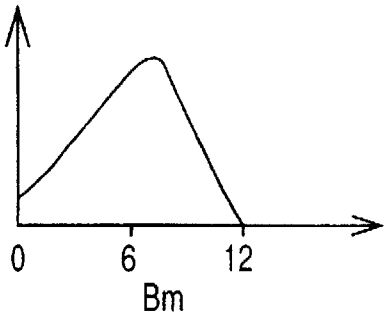
FIG. 6C is a graph showing a distribution of respective blue (B) components of the picture elements of the same embroidery shape.

Step S6 is followed by Step S7 to calculate, for each embroidery shape, a statistic value, Pm, from the sets of color-pixel data $P_i$ corresponding to that embroidery shape. In the present embodiment, the statistic value Pm (=(Rm, Gm, Bm)) is the combination of three statistic values, Rm, Gm, Bm. The statistic value Rm is obtained from the respective red degrees or values (4 bits; 0 to 15) of all the pixels of each embroidery shape; the statistic value Gm is obtained from the respective green values of all the pixels of the same embroidery shape; and the statistic value Bm is obtained from the respective blue values of all the pixels of the same embroidery shape. In the present embodiment, the CPU 2 calculates, as each statistic value Rm, Gm, Bm, a median of the respective red, green, or blue values of all the pixels of each same embroidery shape, as illustrated in FIGS. 6A, 6B, 6C, respectively. Regarding the examples shown in FIGS. 6A, 6B, 6C, the CPU 2 determines 9, 9, and 6 as the respective medians for the red, green, and blue colors, and determines the statistic value Pm=(9, 9, 6).

Step S6 is followed by Step S7 to automatically determine, based on the statistic value Pm=(Rm, Gm, Bm) for each embroidery shape, respective classes of sewing-thread color and stitch density as sewing attributes, according to a look-up table shown in FIG. 7. The look-up table defines a relationship between a plurality of statistic-value combinations Pm and a plurality of classes of each of thread color and stitch density as the sewing attributes. Each of the thread-color classes defines a thread color which is the most nearest to the color represented by a corresponding one of the statistic-value combinations Pm, and each of the stitch-density classes defines a stitch density which is the most nearest to the luminance represented by a corresponding one of the statistic-value combinations Pm. Thus, each embroidery shape is sewn with a sewing thread having a color which is the most nearest to the original color of the embroidery shape in the original image 15, and at a stitch density which is the most appropriate for the original luminance of the embroidery shape in the original image 15. The lower the luminance is, the greater the stitch density is, that is, the higher the luminance is, the smaller the stitch density is. The manner in which different combinations Pm correspond to different classes of sewing thread and different classes of stitch density, respectively, may change depending upon the number of color-different sewing threads which can be used on the sewing machine 20 to which embroidery data are to be supplied. Therefore, various sorts of look-up tables may be stored in the ROM 3, and one of the tables may be selected by the operator through the keyboard 11. For example, the look-up table shown in FIG. 7 is preferably selected for the case where a gray thread cannot be used. The statistic combination (2, 2, 2) represents, in fact, a gray color but corresponds to a black thread and a smaller stitch density (5 stitches/mm) than that (6 stitches/mm) for the combination (0, 0, 0) representing a black color. In the case where a gray thread can be used on the sewing machine 20, another look-up table in which the combination (2, 2, 2) corresponds to a gray thread, may be selected in place of the look-up table of FIG. 7. Thus, the combination of two or more sewing attributes can better correspond to the color characteristic of each embroidery shape. The sewing attributes other than those specified in the look-up table (e.g., stitch pitch, sewing direction, stitching manner, etc.) are input by the operator through the keyboard 11.

The present apparatus 1 may employ a look-up table in which not all statistic combinations Pm do correspond to classes of one or more sewing attributes, for example, in the case where only a small number of color sewing threads can be used on the sewing machine 20. In this case, if the CPU 2 does not find, in the look-up table, any class of a sewing attribute which corresponds to a calculated statistic combination Pm for an embroidery shape, then the CPU 2 determines, at Step S7, one of the classes of the sewing attribute which corresponds to one of the statistic combinations which is the nearest to the calculated combination Pm in a color space. In the same case, alternatively, the CPU 2 may avoid specifying the class of the sewing attribute for the embroidery shape and request the operator to input his or her desired classes of the sewing attribute through the keyboard 11.

Figure 5B:
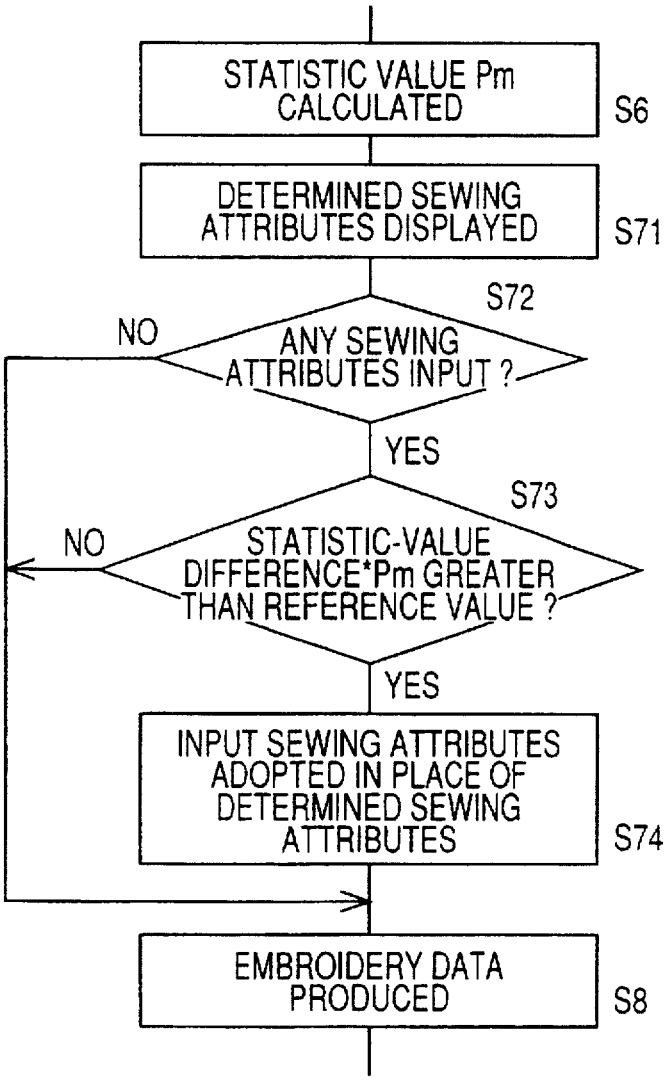
FIG. 5B is a flow chart representing another embroidery-data processing control program obtained by modifying the control program shown in FIG. 5A.

Step S7 of FIG. 5A may be replaced by Steps S71, S72, S73, and S74 shown in FIG. 5B. In this case, at Step S71, the classes of the sewing attributes determined according to the look-up table of FIG. 7 are displayed on the CRT display 7. At Step S72, the CPU 2 displays, on the image screen 7*a*, a message "PLEASE INPUT DESIRED CLASSES OF SEWING ATTRIBUTES". If the operator wants to use different attribute classes from the automatically determined attribute classes, he or she inputs those classes through the keyboard 11. In the latter case, the control of the CPU 2 goes to Step S73 to determine the difference or distance between the calculated combination Pm and the nearest combination in the look-up table, in the color space, and, if the difference is greater than a reference value, the CPU 2 adopts, at Step S74, the operator input attribute classes in place of the automatically determined attribute classes. On the other hand, if not, the CPU 2 maintains the automatically determined attribute classes, while discarding the operator input attribute classes. In FIG. 5B, Step S73 may be omitted. In the last case, if the operator input his or her desired attribute classes, the CPU 2 unconditionally adopts, at Step S74, the operator input attribute classes in place of the automatically determined attribute classes.

Step S7 is followed by Step S8 to produce a batch of embroidery data for each embroidery shape, by utilizing the set of embroidery-shape data therefor stored in the storage area 4B of the RAM 4 and the classes of the sewing attributes determined at Step S7 or input at Step S72. The batch(es) of embroidery data obtained from the original image 15 are stored, in the flash-memory card 10, with a file name identifying the original image 15. The embroidery data may comprise a number of sets of stitch-position data defining a number of stitch positions, i.e., a number of sets of x and y coordinates on the x-y coordinate system of the sewing machine 20. Otherwise, the embroidery data may comprise a number of sets of block data defining a number of rectangle and/or triangle blocks, and sewing- attribute data indicating the determined classes of sewing thread and stitch density as the sewing attributes. In the latter case, the control device of the sewing machine 20 automatically determines the stitch positions or the sets of x and y coordinates from the sets of block data and the sewing-attribute data stored as the embroidery data in the flash memory card 10. Thus, the embroidery-data processing control operation according to the flow chart of FIG. 5A or FIG. 5B is finished.

Then, the operator removes the flash-memory card 10 from the writing and reading device 8 of the processing apparatus 1, and inserts the card 10 into the card slot 24 of the card reading device of the sewing machine 20. When the operator input the file name (e.g., four-digit number) through a keyboard (not shown) provided on the machine 20, the control device (not shown) of the machine 20 controls the sewing needle 23, the holder moving device 26, and a shuttle (not shown), according to the embroidery data stored in the card 10, so that a color embroidery corresponding to the original image 15 is formed on the work sheet 22 held by the work holder 21.

While in the present embodiment the respective median values of the red, green, and blue components of the pixels of each embroidery shape are calculated as the statistic-value combination Pm=(Rm, Gm, Bm), it is possible to calculate, as the statistic-value combination Pm=(Rm, Gm, Bm), the respective average values or respective maximum likelihood values of the red, green, and blue components of the pixels of each embroidery shape. Alternatively, it is possible that the CPU 2 determine appropriate classes of the sewing attributes based on both the respective average values and respective maximum likelihood values of the red, green, and blue components of the pixels of each embroidery shape.

Next, there will be described a second embodiment of the present invention. The second embodiment also relates to an embroidery-data processing apparatus having the same hardware construction as that of the first embodiment shown in FIGS. 1, 3, and 4. However, in the second embodiment, a look-up table shown in FIG. 9 is employed and stored in the ROM 3, in place of the look-up table shown in FIG. 7. The look-up table of FIG. 9 defines a relationship between a plurality of density values as statistic values and a plurality of stitch-density values as sewing-attribute classes. In the second embodiment, the control device 9 operates according to the same steps as Steps S1 to S5 of FIG. 5A. That is, at Step S5, the CPU 2 obtains, from the sets of color-pixel data $C_i$, sets of color-pixel data $P_i$ corresponding to all the pixels of each embroidery shape.

At Step S6, the CPU 2 calculates, as a statistic value, a luminance, Y, corresponding to a color characteristic of each embroidery shape, from the sets of color-pixel data $P_i$. This luminance may be calculated by multiplying the red (R), green (G), and blue (B) degrees or values (4 bits; 0 to 15) of each of the pixels of each embroidery shape, by three predetermined coefficients, respectively, and summing up all the obtained products.

Then, at Step S7, the CPU 2 determines, in the look-up table of FIG. 9, one of classes of stitch density as a sewing attribute which corresponds to the luminance calculated at Step S7. At Step S8, the CPU 2 produces a batch of embroidery data for each embroidery shape, by utilizing the set of embroidery-shape data stored in the RAM 4 and the stitch density determined at Step S7. Thus, one cycle of control operation is finished.

In the second embodiment, the full-color image scanner 12 may be replaced by a monochromatic image scanner which produces sets of gray-scale pixel data representing the respective gray-scale degrees or values of the pixels of an original image. In this case, too, the CPU 2 can obtain a luminance value from the sets of gray-scale pixel data corresponding to all the pixels of each embroidery shape.

While the present invention has been described in its preferred embodiments, it is to be understood that the present invention may be embodied with other changes, improvements, and modifications that may occur to those skilled in the art without departing from the spirit and scope of the invention defined in the appended claims.

What is claimed is:

1. An apparatus for processing embroidery data according to which a sewing machine produces an embroidery on a work sheet, comprising:

embroidery-shape determining means for determining at least one embroidery shape in an original image, based on original-image data representing the original image;

characteristic-data determining means for determining characteristic data based on a color characteristic of the embroidery shape determined by said embroidery-shape determining means; and sewing-attribute determining means for determining at least one sewing attribute relating to sewing of the embroidery shape, based on said characteristic data determined by said characteristic-data determining means, said at least one sewing attribute comprising a stitch density at which the sewing machine sews the embroidery shape.

2. An apparatus according to claim 1, further comprising embroidery-data producing means for producing said embroidery data based on the sewing attribute determined by said sewing-attribute determining means.

3. An apparatus according to claim 2, wherein said embroidery-data producing means comprises means for producing said embroidery data comprising a plurality of sets of stitch-position data defining a plurality of stitch positions where a sewing needle of the sewing machine penetrates the work sheet, and wherein said sewing-attribute determining means comprises means for determining, as said sewing attribute, said stitch density indicating a number of stitches formed in unit length in an embroidery direction in the embroidery shape.

4. An apparatus according to claim 2, wherein said embroidery-data producing means comprises means for producing said embroidery data comprising (a) a plurality of sets of block data defining a plurality of rectangle blocks each of which is to be filled with stitches formed by the sewing machine, and (b) said sewing attribute, and wherein said sewing-attribute determining means comprises means for determining, as said sewing attribute, said stitch density indicating a number of stitches formed in said each block.

5. An embroidery-data processing apparatus according to claim 2, further comprising a recording device which records said embroidery data produced by said embroidery-data producing means, on a recording medium which is removable from the embroidery-data processing apparatus.

6. An apparatus according to claim 1, further comprising an original-image-data obtaining device which obtains said original-image data.

7. An apparatus according to claim 6, wherein said original-image-data obtaining device comprises an image pick-up device which picks up the original image on which at least one outline of an embroidery area has been recorded with a recording material, said image pick-up device producing said original-image data representing the original image, and wherein said embroidery-shape determining means comprises means for determining, as the embroidery shape, the embroidery area in the original image, based on said original-image data which are produced by said image pick-up device and which include outline data representing the outline of the embroidery area recorded with the recording material.

8. An apparatus according to claim 6, wherein said original-image-data obtaining device comprises:

an image pick-up device which picks up the original image and produces said original-image data representing the original image;

a display device which displays the original image represented by said original-image data; and an input device which is operable by a user for inputting line data representing at least one of (a) at least one outline of an embroidery area and (b) an embroidery line segment, while the user views the original image displayed by said display device, and wherein said embroidery-shape determining means comprises means for determining, as the embroidery shape, said at least one of the embroidery area and the embroidery line segment in the original image, based on said line data input through said input device.

9. An apparatus according to claim 6, wherein said original-image-data obtaining device comprises color-data obtaining means for obtaining said original-image data comprising a plurality of sets of color data relating to respective colors of a plurality of picture elements of the original image.

10. An apparatus according to claim 9, wherein said characteristic-data determining means comprises statistic-value determining means for statistically processing the sets of color data relating to the respective colors of the picture elements each of which belongs to the embroidery shape, and determining at least one statistic value as said characteristic data.

11. An apparatus according to claim 10, further comprising a memory which stores the sets of color data relating to the respective colors of the picture elements each of which belongs to the embroidery shape.

12. An apparatus according to claim 10, wherein said color-data obtaining means comprises means for obtaining said sets of color data each set of which comprises red data indicating a red degree of the color of a corresponding one of the picture elements of the original image, green data indicating a green degree of the color of said corresponding one picture element, and blue data indicating a blue degree of the color of said corresponding one picture element.

13. An apparatus according to claim 12, wherein said statistic-value determining means comprises means for determining, as said at least one statistic value, a median of the respective red degrees, a median of the respective green degrees, and a median of the respective blue degrees, of the picture elements of the embroidery shape.

14. An apparatus according to claim 12, wherein said sewing-attribute determining means comprises means for determining said at least one sewing attribute comprising said stitch density and a color of at least one sewing thread with which the sewing machine sews the embroidery shape.

15. An apparatus according to claim 10, wherein said color-data obtaining means comprises means for obtaining said sets of color data each set of which comprises color-density data indicating a density of the color of a corresponding one of the picture elements of the original image.

16. An apparatus according to claim 15, wherein said statistic-value determining means comprises color-density-using static-value determining means for determining said statistic value based on the respective color densities of the picture elements of the embroidery shape.

17. An apparatus according to claim 16, wherein said color-density-using statistic-value determining means comprises means for determining, as said statistic value, a sum of respective luminances as the respective color densities of the picture elements of the embroidery shape.

18. An apparatus according to claim 1, further comprising a memory which stores said original image data.

19. An apparatus according to claim 1, wherein said sewing-attribute determining means comprises a memory which stores a relationship between a plurality of values of the characteristic data and a plurality of classes of the sewing attribute which correspond to the values of the characteristic data, respectively; and means for determining, as said sewing attribute, one of the classes of the sewing attribute which corresponds to one of the values of the characteristic data which is nearest to a value of the characteristic data determined by said characteristic-data determining means.

20. An apparatus according to claim 1, wherein said sewing-attribute determining means comprises a memory which stores a relationship between a plurality of discontinuous values of the characteristic data and a plurality of classes of the sewing attribute which correspond to the values of the characteristic data, respectively; means for determining, as said sewing attribute, one of the classes of the sewing attribute which corresponds to one of the values of the characteristic data which is nearest to a value of the characteristic data determined by said characteristic-data determining means; an input device which is operable by a user for inputting data indicating a desired class of the sewing attribute; and means for adopting, as said sewing attribute, said desired class of the sewing attribute input through said input device, when a difference between said value of the characteristic data determined by said characteristic-data determining means and said one value of the characteristic data which is nearest to said value of the characteristic data determined by said characteristic-data determining means is greater than a reference value.

21. An apparatus for processing embroidery data according to which a sewing machine produces an embroidery on a work sheet, comprising:

embroidery-shape determining means for determining at least one embroidery shape in an original image, based on original-image data representing the original image;

characteristic-data determining means for determining characteristic data based on a color characteristic of the embroidery shape determined by said embroidery-shape determining means; and sewing-attribute determining means for determining at least one sewing attribute relating to sewing of the embroidery shape, based on said characteristic data determined by said characteristic-data determining means, said sewing-attribute determining means comprising a memory which stores a relationship between a plurality of values of the characteristic data and a plurality of classes of the sewing attribute which correspond to the values of the characteristic data, respectively, and a means for determining, as said sewing attribute, one of the classes of the sewing attribute which corresponds to one of the values of the characteristic data which is nearest to a value of the characteristic data determined by said characteristic-data determining means.

22. An apparatus for processing embroidery data according to which a sewing machine produces an embroidery on a work sheet, comprising:

embroidery-shape determining means for determining at least one embroidery shape in an original image, based on original-image data representing the original image;

characteristic-data determining means for determining characteristic data based on a color characteristic of the embroidery shape determined by said embroidery-shape determining means;

sewing-attribute determining means for determining one of a plurality of classes of at least one sewing attribute relating to sewing of the embroidery shape, based on said characteristic data determined by said characteristic-data determining means;

an input device which is operable by a user for inputting data indicating a desired class of the sewing attribute; and a means for adopting, according to a predetermined rule, said desired class of the sewing attribute input through said input device, in place of said one class of the sewing attribute determined by said sewing-attribute determining means.

23. A process of processing embroidery data according to which a sewing machine produces an embroidery on a work sheet, comprising the steps of:

recording, with a recording material, at least one outline defining an embroidery area in an original image, obtaining original-image data representing the original image including said at least one outline, determining, based on said original-image data, said embroidery area defined by said at least one outline, determining characteristic data based on a color characteristic of the determined embroidery area, and determining at least one sewing attribute relating to sewing of said embroidery area, based on the determined characteristic data.

24. A process according to claim 23, wherein the step of determining said at least one sewing attribute comprises determining said at least one sewing attribute comprising at least one of a stitch density and a color of a sewing thread.

25. A process according to claim 23, further comprising the step of producing said embroidery data based on the determined sewing attribute.

26. A process according to claim 25, further comprising the step of producing the embroidery on the work sheet according to the produced embroidery data.

27. A recording medium in which a control program is recorded which is readable by a computer and usable to process embroidery data according to which a sewing machine produces an embroidery on a work sheet, the program comprising the steps of:

determining at least one embroidery shape in an original image, based on original-image data representing the original image, determining characteristic data based on a color characteristic of the determined embroidery shape, and determining at least one sewing attribute relating to sewing of the embroidery shape, based on the determined characteristic data, said at least one sewing attribute comprising a stitch density at which the sewing machine sews the embroidery shape.

28. A medium according to claim 27, wherein the control program further comprises the step of producing said embroidery data based on the determined sewing attribute.

29. A medium according to claim 28, wherein the control program further comprises the step of recording said embroidery data on a recording medium which is removable from the computer.

30. A medium according to claim 27, wherein the control program further comprises the step of obtaining said original-image data.

* * * * *